US007849532B1

(12) United States Patent
Servais

(10) Patent No.: US 7,849,532 B1
(45) Date of Patent: Dec. 14, 2010

(54) MOVEMENT ASSISTING BED COVERING SYSTEM

(76) Inventor: Jacqueline M. Servais, 8341 Lyndale Ave. South, Bloomington, MN (US) 55420

( * ) Notice: Subject to any disclaimer, the term of this patent is extended or adjusted under 35 U.S.C. 154(b) by 0 days.

(21) Appl. No.: 12/407,371

(22) Filed: Mar. 19, 2009

(51) Int. Cl.
*A61G 7/14* (2006.01)

(52) U.S. Cl. ..... 5/81.1 HS; 5/486

(58) Field of Classification Search ..... 5/485, 5/486, 493, 81.1 HS, 925, 926
See application file for complete search history.

(56) References Cited

U.S. PATENT DOCUMENTS

| | | | | |
|---|---|---|---|---|
| 1,334,901 | A | 3/1920 | Higdon | |
| 3,205,514 | A * | 9/1965 | Pietrangeli | 5/484 |
| 3,849,813 | A | 11/1974 | Nielson | |
| 5,111,544 | A * | 5/1992 | Graebe | 5/654 |
| D339,771 | S | 9/1993 | Newman | |
| 5,329,655 | A | 7/1994 | Garner | |
| 5,638,558 | A | 6/1997 | Moore | |
| 5,787,523 | A | 8/1998 | Lindberg | |
| 6,728,978 | B1 * | 5/2004 | Nordin | 5/81.1 HS |
| 6,732,389 | B2 * | 5/2004 | Drexler | 5/486 |
| 6,842,921 | B1 * | 1/2005 | Tsiarkezos et al. | 5/497 |
| 2005/0055768 | A1 | 3/2005 | Assink | |

* cited by examiner

*Primary Examiner*—Michael Trettel

(57) ABSTRACT

A movement assisting bed covering system includes a rectangular central panel of satin or sateen cloth having an upper surface, a lower surface, a first lateral edge, a second lateral edge, a first end edge and a second end edge. Each of the first and second end edges has one of a pair of end panels attached thereto. The end panels have a higher coefficient of friction than the central panel. The central panel is positionable on the mattress to cover a central area of the mattress while leaving areas of an upper surface of the mattress adjacent to a head and a foot of the mattress at least partially exposed. Each of the end panels is positionable below the mattress and abuttable against a lower side of the mattress to retain the central panel on the mattress.

7 Claims, 2 Drawing Sheets

MOVEMENT ASSISTING BED COVERING SYSTEM

BACKGROUND OF THE DISCLOSURE

Field of the Disclosure

The disclosure relates to bed motion easing devices and more particularly pertains to a new bed motion easing device for allowing greater ease of movement across a bed surface.

SUMMARY OF THE DISCLOSURE

An embodiment of the disclosure meets the needs presented above by generally comprising a rectangular central panel comprising cloth and having an upper surface, a lower surface, a first lateral edge, a second lateral edge, a first end edge and a second end edge. The central panel consists of a satin cloth or a sateen cloth. Each of the first and second end edges has one of a pair of end panels attached thereto. The end panels have a higher coefficient of friction than the central panel. The central panel is positionable on the mattress to cover a central area of the mattress while leaving areas of an upper surface of the mattress adjacent to a head and a foot of the mattress at least partially exposed. Each of the end panels is positionable below the mattress and abuttable against a lower side of the mattress to retain the central panel on the mattress.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
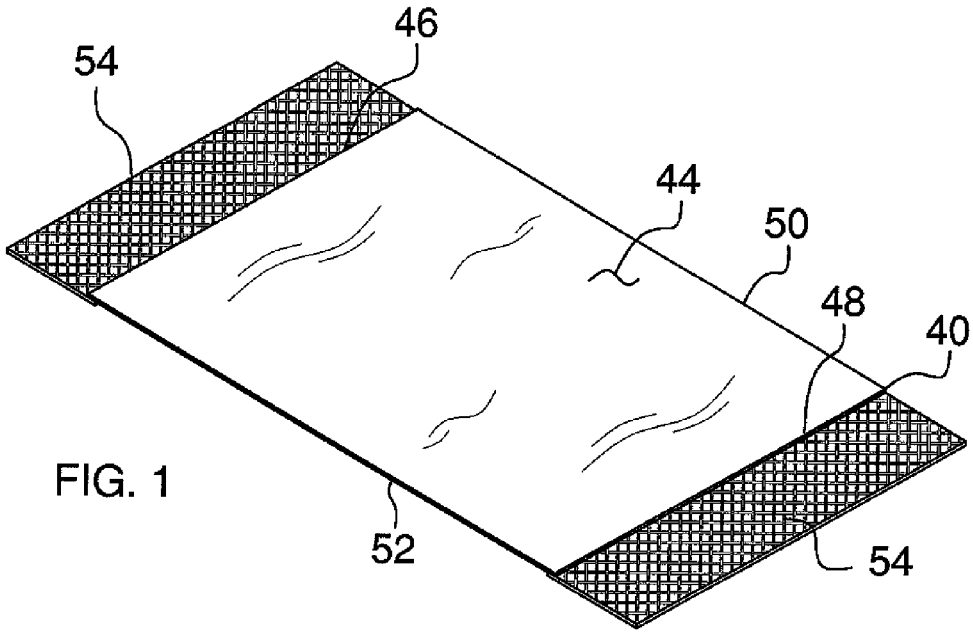
FIG. 1 is a bottom perspective view of a movement assisting bed covering system according to an embodiment of the disclosure.

With reference now to the drawings, and in particular to FIGS. 1 through 4 thereof, a new bed motion easing device embodying the principles and concepts of an embodiment of the disclosure and generally designated by the reference numeral 10 will be described.

Figure 2:
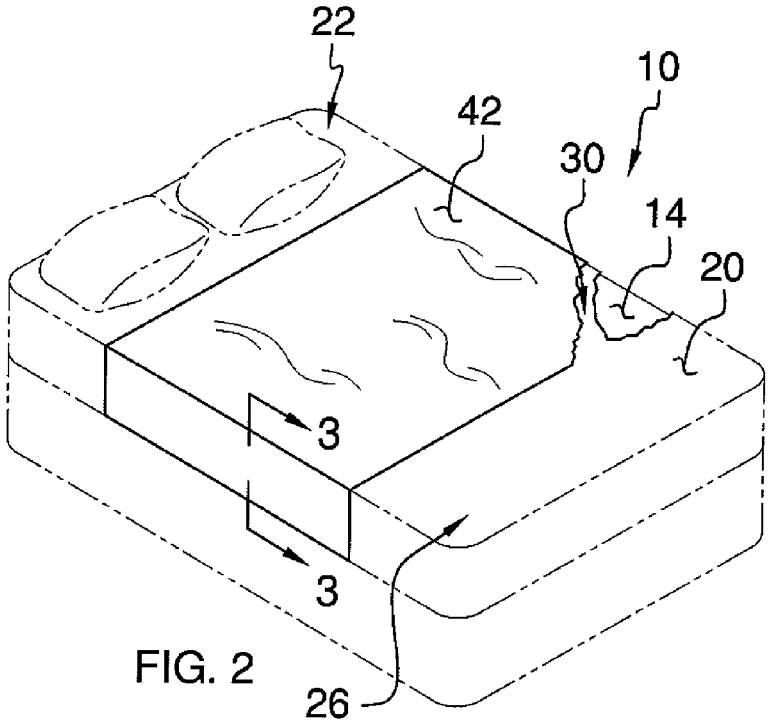
FIG. 2 is a broken top perspective view of an embodiment of the disclosure.
Figure 3:
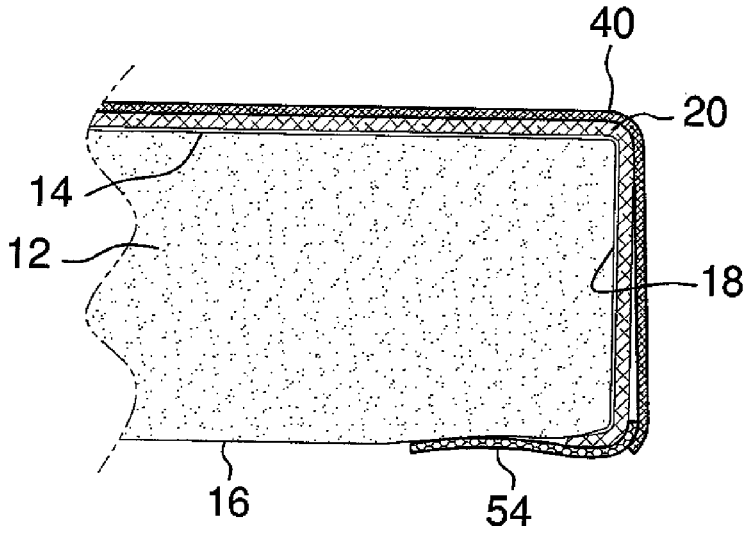
FIG. 3 is a cross-sectional view taken along line 3-3 of FIG. 2 of an embodiment of the disclosure.
Figure 4:
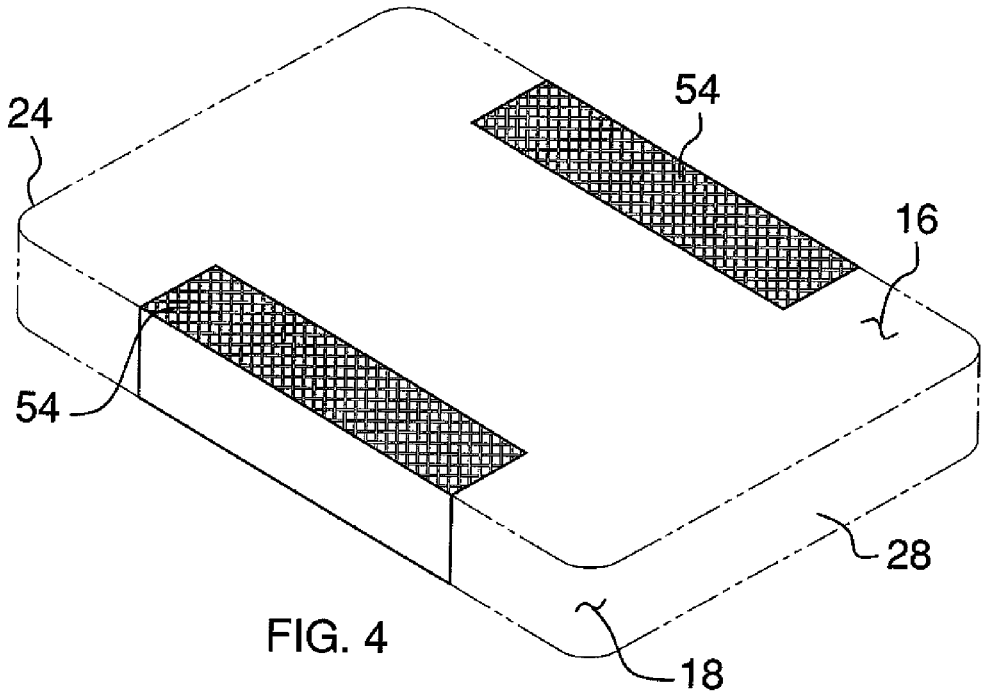
FIG. 4 is a bottom perspective view of an embodiment of the disclosure.

As best illustrated in FIGS. 1 through 4, the movement assisting bed covering system 10 generally comprises a mattress 12 that has an upper side 14, a lower side 16 and a peripheral edge 18 extending between the upper 14 and lower 16 sides. A mattress covering 20, or bed sheet, is positioned on and completely covers the upper side 14 and extends over at least a partial portion of the peripheral edge 18. FIGS. 2 and 3 depict the mattress 12 having the mattress covering 20 thereon whereas FIG. 4 depicts usage of the system 10 without a mattress covering 20.

A rectangular shaped central panel 40 comprises cloth and has an upper surface 42, a lower surface 44, a first lateral edge 50, a second lateral edge 48, a first end edge 50 and a second end edge 52. The upper surface 42 has a lower coefficient of friction with respect to the mattress covering 20. The upper surface 42 may have a width from the first end edge 46 to the second end edge 48 at least as long as a width of the mattress 12 so that it will cover the mattress 12 between its lateral edges. The central panel 40 consists of a satin cloth or a sateen cloth, which will be conventional and likely include an upper surface that is glossy.

A pair of rectangular shaped end panels 54 is provided. Each of the first 46 and second 48 end edges has one of the end panels 54 attached thereto. The end panels 54 are coextensive with an attached one of the first 46 and second 48 end edges. Each of the end panels 54 has a greater coefficient of friction greater with respect to the mattress covering 20 and therefore a greater coefficient of friction with respect to the central panel 40. The coefficient of friction is being compared relative to a conventional cotton bed sheet not having a sateen finish. Each of the end panels 54 includes a mesh material having an outer surface comprising an elastomer.

The mattress covering 20 includes an upper end portion 22 positioned on the upper side 14 adjacent to a head 24 of the mattress 12, a lower end portion 26 positioned on the upper side 14 adjacent to a foot 28 of the mattress 14 and a central portion 30 positioned between the upper 22 and lower 26 end portions. The central panel 40 is positioned on and covers the central portion 30 while exposing the upper 22 and lower 26 end portions. Each of the end panels 54 is positioned below the mattress 12 and abuts the lower side 16 to retain the central panel 40 on the mattress covering 20.

In use, the central panel 40 is positioned on a mattress 12, with or without a bed covering 20 positioned between the mattress 12 and the central panel 40, to provide a surface on which a person may more easily slide onto or off of the mattress 12. This will be particularly useful for a person who is not very mobile. The end panels 54 prevent the central panel 40 from being dislodged from the mattress 12 while the person slides across the mattress. By not fully covering the mattress 12 cover with the central panel 40, bedding on the mattress 12 overall is more breathable for the person using the mattress 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A movement assisting system to ease movement of a person attempting to remove themselves from a bed, said system including:

a mattress having an upper side, a lower side and a peripheral edge extending between said upper and lower sides;

a mattress covering being positioned on and completely covering said upper side and extending over at least a partial portion of said peripheral edge;

a central panel comprising cloth and having an upper surface, a lower surface, a first lateral edge, a second lateral edge, a first end edge and a second end edge, said upper surface having a lower coefficient of friction with respect to said mattress covering;

a pair of end panels, each of said first and second end edges having one of said end panels attached thereto, each of said end panels having a greater coefficient of friction greater with respect to said mattress covering, each of said end panels including a mesh material having an outer surface comprising an elastomer; and said mattress covering including an upper end portion positioned on said upper side adjacent to a head of the mattress, a lower end portion positioned on said upper side adjacent to a foot of the mattress and a central portion positioned between said upper and lower end portions, said central panel being positioned on and covering said central portion while exposing said upper and lower end portions, each of said end panels being positioned below said mattress and abutting said lower side to retain said central panel on said mattress covering.

2. The system according to claim 1, wherein said upper surface has a width from said first end edge to said second end edge at least as long as a width of said mattress.

3. The system according to claim 1, wherein said central panel consists of a satin cloth or a sateen cloth.

4. The system according to claim 1, wherein said end panels are coextensive with an attached one of said first and second end edges.

5. A movement assisting system to ease movement of a person attempting to remove themselves from a bed, said system including:

a mattress having an upper side, a lower side and a peripheral edge extending between said upper and lower sides;

a mattress covering being positioned on and completely covering said upper side and extending over at least a partial portion of said peripheral edge;

a central panel comprising cloth and having an upper surface, a lower surface, a first lateral edge, a second lateral edge, a first end edge and a second end edge, said upper surface having a lower coefficient of friction with respect to said mattress covering, said upper surface having a width from said first end edge to said second end edge at least as long as a width of said mattress, said central panel consisting of a satin cloth or a sateen cloth wherein said upper surface is glossy;

a pair of end panels, each of said first and second end edges having one of said end panels attached thereto, said end panels being coextensive with an attached one of said first and second end edges, each of said end panels having a greater coefficient of friction greater with respect to said mattress covering, each of said end panels includes a mesh material having an outer surface comprising an elastomer; and said mattress covering including an upper end portion positioned on said upper side adjacent to a head of the mattress, a lower end portion positioned on said upper side adjacent to a foot of the mattress and a central portion positioned between said upper and lower end portions, said central panel being positioned on and covering said central portion while exposing said upper and lower end portions, each of said end panels being positioned below said mattress and abutting said lower side to retain said central panel on said mattress covering.

6. A movement assisting apparatus being positionable on a mattress, said apparatus including:

a rectangular central panel having an upper surface, a lower surface, a first lateral edge, a second lateral edge, a first end edge and a second end edge, said central panel consisting of a satin cloth or a sateen cloth;

a pair of end panels, each of said first and second end edges having one of said end panels attached thereto, said end panels each having a higher coefficient of friction than said central panel, each of said end panels including a mesh material having an outer surface comprising an elastomer;

wherein said central panel is positionable on the mattress to cover a central area of the mattress while leaving areas of an upper surface of the mattress adjacent to a head and a foot of the mattress at least partially exposed; and wherein each of said end panels is positionable below the mattress and abuttable against a lower side of the mattress to retain said central panel on the mattress.

7. The apparatus as in claim 6, wherein each of said panels is rectangular shaped.

* * * * *